US005880325A

United States Patent [19]

Alward et al.

[11] Patent Number: 5,880,325

[45] Date of Patent: Mar. 9, 1999

[54] AROMATICS EXTRACTION FROM HYDROCARBON OIL USING TETRAMETHYLENE SULFOXIDE

[75] Inventors: Sandra J. Alward; William N. Hayter, both of Sarnia, Canada

[73] Assignee: Exxon Research and Engineering Company, Florham Park, N.J.

[21] Appl. No.: 116,932

[22] Filed: Sep. 7, 1993

[51] Int. Cl.[6] ..... C07C 7/10

[52] U.S. Cl. ..... 585/833; 585/856; 585/857

[58] Field of Search ..... 585/856, 857, 585/865; 203/51, 58

[56] References Cited

U.S. PATENT DOCUMENTS

| | | | |
|---|---|---|---|
| 3,092,571 | 6/1963 | Francis | 585/656 |
| 4,280,881 | 7/1981 | Montagna et al. | 203/51 |
| 4,371,428 | 2/1983 | Montagna et al. | 203/51 |

FOREIGN PATENT DOCUMENTS

| | | | |
|---|---|---|---|
| 9086330 | 8/1974 | Japan . | |
| 499256 | 1/1976 | U.S.S.R. | C07C 7/10 |
| 1161505 | 6/1985 | U.S.S.R. | 585/856 |

OTHER PUBLICATIONS

"Liquid–Liquid Equilibrium Studies for Separation of Aromatics" Rawat, et al. J. Appl. Chem. Biotechnol, 1976, 26, 425–435.

*Primary Examiner*—Glenn A. Caldarola
*Attorney, Agent, or Firm*—Joseph J. Allocca

[57] ABSTRACT

Aromatic hydrocarbons are selectively extracted from lube oil stocks comprising mixtures of same with non-aromatic hydrocarbons using tetramethyl sulfoxide as the extraction solvent. The oils so extracted are the heavier oils, those boiling above about 200° C. and identified as being at least lube base stock grade 60N and higher.

8 Claims, No Drawings

AROMATICS EXTRACTION FROM HYDROCARBON OIL USING TETRAMETHYLENE SULFOXIDE

BRIEF DESCRIPTION OF THE INVENTION

Aromatic hydrocarbons, particularly polynuclear aromatic hydrocarbons are selectively extracted from hydrocarbon lube oils comprising mixtures of same with other aromatic and non-aromatic hydrocarbons by the process comprising contacting said hydrocarbon lube oil with a selective aromatic extraction solvent comprising tetramethylene sulfoxide.

The oil which is fed to the extraction process preferably boils above about 200° C. and is identified as being lube base stock grade of at least 60N and higher, preferably those boiling above about 260° C. and identified as being lube base stock grade of at least 100N and higher.

BACKGROUND OF THE INVENTION

U.S. Pat. No. 4,280,881 teaches a method for separating indene from mixtures of same with aromatic mono-olefins by extractive distillation using polar organic liquids containing oxygen, sulfur or nitrogen. Such polar organic liquids include sulfolane, 2-pyrrolidone, gamma butyrolactone, ethylene carbonate, tetramethylene sulfoxide, epsilon-caprolactam, an N-lower alkyl-2 pyrrolidone and/or a di-lower alkyl sulfoxide.

U.S. Pat. No. 4,371,428 teaches a method for separating vinyl toluene from other alkenyl-aromatics by extractive distillation using polar organic compounds as extractant. Such polar organic compounds contain oxygen, sulfur or nitrogen and have an atmospheric boiling point between 185° and 300° C., and includes tetramethylene sulfoxide as well as various pyrrolidones and sulfolane.

Japanese J49086330 teaches a method for removing 9–10 carbon atom aromatic hydrocarbons from aromatic mixtures by distillation with NN dialkylamides, tetramethylene sulfoxide, nitrites, nitrobenzenes, phosphates, sulfolane.

"Liquid—Liquid Equilibrium Studies for Separation of Aromatics" Rawat, et al, J. applied Chem Biotechnol. 1976 26, 425–435. This Article reports the separation of benzene/heptane and toluene/heptane for 11 solvents. The article indicates that 1,3-propane sultone was the best solvent. Table 3 shows sulfolane and DMSO to be more selective than TMSO when used for the extraction of toluene from heptane.

SU 499256 reports that the efficiency of the separation of aromatic hydrocarbons from their mixtures with non-aromatic hydrocarbons by liquid phase extraction is improved, when cyclic sulfoxides of formula

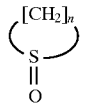

where n=3–5, or their mixtures with water, are used as extractants. The process is stated in its abstract as finding use in the separation of cracking products. Review of the text reveals, however, that only mixtures of heptane-toluene were investigated and used to demonstrate the process.

DESCRIPTION OF THE INVENTION

Polynuclear aromatic hydrocarbons are selectively extracted from hydrocarbon oils comprising mixtures of same with other aromatic hydrocarbons and non-aromatic hydrocarbons by a process comprising contacting the hydrocarbon oil with a selective extraction solvent comprising tetramethylene sulfoxide.

The aromatic hydrocarbons selectively removed from the hydrocarbon feed stream are the $2^+$ ring aromatics and their substituted derivatives, including heteroatom containing derivative groups as used herein, the term aromatic hydrocarbon includes $2^+$ ring aromatics and their substituted derivatives, including $2^+$ ring heteroatom aromatics and their substituted derivative, e.g., benzo-thiophenes and substituted benzo-thiophenes, and including the $2^+$ ring heteroatom aromatics and their substituted derivatives.

The hydrocarbon oils which are subjected to the extraction process are those in the lube oil boiling range, typically those boiling above about 200° C., preferably above about 260° C., most preferably above about 320° C. They may also be identified by their grade designation such as at least a 60N oil, preferably at least a 150N, most preferably at least 600N grade oil.

The oil is contacted with tetramethylene sulfoxide so as to intimately combine the hydrocarbon oil with the TMSO. Such contacted may be conducted under either batch mixing or countercurrent contacting conditions.

In batch mixing a volume of oil to be extracted is combined with a quantity of solvent and subjected to agitation. The agitation is stopped and the mixture is permitted to separate into two phases, one phase comprising the solvent and polynuclear aromatic hydrocarbons dissolved therein (called the extract phase) and a second phase comprising the non-aromatic hydrocarbons, mononuclear aromatics and other hydrocarbons (called the raffinate phase).

Alternatively the hydrocarbon feed can be extracted using countercurrent extraction. In that procedure the hydrocarbon feed is introduced into either the top or the bottom of an elongated column separation vessel with the solvent being introduced at the opposite end. The feed and solvent pass countercurrently with respect to each other with a raffinate phase and an extract phase being recovered from opposite ends of the elongated vessel.

The raffinate and extract phases are then subjected to solvent recovery procedures such as distillation, water springing, steam springing or thermal springing (or a combination thereof) to separate the solvent from the respective hydrocarbons present in the different phases. The recovered hydrocarbons are then sent on for further processing which can include recycle to the separation vessel if additional extraction is desired. The recovered solvent is also recycled to the vessel with fresh make up solvent added as needed.

In using TMSO as the extraction solvent, from 0.5 to 10 volumes of TMSO are used per volume of oil feed, preferably from 1 to 5 volumes of TMSO are used per volume of oil feed; most preferably from 1 to 2.5 volumes of TMSO are used per volume of oil feed.

Extraction is conducted at a temperature of from 20° to 150° C., preferably 20° to 100° C., most preferably 20° to 70° C. The extraction is also typically conducted over a temperature gradient of 0° to 40° C., preferably 0° to 20° C., most preferably 0° to 10° C. difference in temperature between the solvent introduction end of the separation vessel as compared to the extract recovery end of said vessel, the solvent introduction end being at a higher temperature.

The TMSO extraction solvent can be used neat, that is, in the absence of water, but water can be present as a co-solvent in an amount in the range 0 to 20 wt % $H_2O$, preferably 0 to 10 wt % $H_2O$, most preferably 0 to 5 wt % $H_2O$ based on the amount of TMSO used.

EXAMPLES

Batch extraction experiments have been carried out on a model compound blend containing a mixture of C24 paraffins, C25 alkylated indans, C26 alkylated tetralins, C27 alkylated naphthalenes and C27 alkylated anthracenes. The structures of the model compound blend are shown below.

1
SATURATES

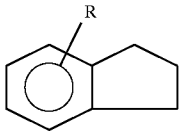

2
INDANES

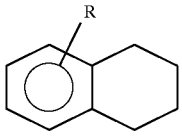

3
TETRALINS
R = HEXADECANE (C16)
$R^2$ = DODECANE (C12)

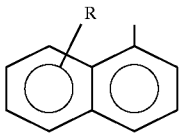

4
NAPHTHALENES

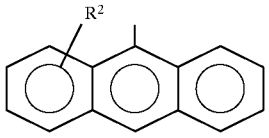

5
ANTHRACENES

This data shows that tetramethylene sulfoxide unexpectedly and in contradiction of the teachings of the literature has a better selectivity and capacity combination than any of the other solvents (including the currently practiced NMP/water solvent system) for selectivity extracting aromatics from the heavier lube oil feeds as compared to light mixtures of toluene/heptane.

The composition of the model compound blend was 48.71 wt % compound 1, 12.32 wt % compound 2, 12.82 wt % compound 3, 13.19 wt % compound 4 and 12.96 wt % compound 5. Five solvents were tested in batch extraction experiments to measure their ability to remove aromatics from the model compound blend. The experimental conditions and selectivity factors are given in Table 1.

It can be seen from Table 1 that the selectivity of the tetramethylene sulfoxide is much better than that of the currently used solvents for extraction of lubricating oils (i.e. NMP or furfural). The extractive removal of aromatics increases the quality of a lube oil while decreasing its yield. Because of its better selectivity, the use of tetramethylene sulfoxide could give increased product yields for a given product quality relative to the current solvents.

What is claimed is:

1. A method for removing aromatic hydrocarbons from hydrocarbon lube oil feedstocks boiling above about 200° C. comprising contacting the feedstock with tetramethyl sulfoxide solvent (TMSO) thereby producing a raffinate of reduced aromatic hydrocarbon content and an extract containing a majority of the TMSO solvent and an increased aromatic hydrocarbon content as compared to the starting feedstock.

TABLE 1

| Solvent | Volume | Feed | Temperature | Compound | Selectivity | Capacity |
|---|---|---|---|---|---|---|
| N-methyl Pyrrolidine | 6 ml | 3.5 g | 25° C. | 2 | 5.09 | 0.063 |
| | | | | 3 | 4.69 | 0.058 |
| | | | | 4 | 11.53 | 0.143 |
| | | | | 5 | 29.71 | 0.368 |
| N-methyl Pyrrolidine | 4 ml | 3.5 g | 25° C. | 2 | 5.19 | |
| | | | | 3 | 4.79 | |
| | | | | 4 | 11.81 | |
| | | | | 5 | 29.02 | |
| N-methyl Pyrrolidine | 5.9 ml | 3.5 g | 24° C. | 2 | 7.20 | 0.019 |
| Water | 0.1 ml | | | 3 | 6.63 | 0.018 |
| | | | | 4 | 17.67 | 0.048 |
| | | | | 5 | 62.31 | 0.168 |
| N-methyl Pyrrolidine | 5.75 ml | 3.5 g | 24° C. | 2 | 8.36 | 0.010 |
| Water | 0.25 ml | | | 3 | 7.34 | 0.009 |
| | | | | 4 | 21.41 | 0.025 |
| | | | | 5 | 86.75 | 0.102 |
| N-methyl Pyrrolidine | 5.5 ml | 3.5 g | 23° C. | 2 | 8.91 | 0.002 |
| Water | 0.5 ml | | | 3 | 8.14 | 0.002 |
| | | | | 4 | 21.87 | 0.005 |
| | | | | 5 | 102.52 | 0.023 |
| Dimethyl Sulfoxide | 6 ml | 3.5 g | 22° C. | 2 | 5.05 | 0.001 |
| | | | | 3 | 4.73 | 0.001 |
| | | | | 4 | 10.88 | 0.002 |
| | | | | 5 | 35.26 | 0.005 |
| Sulfolane | 6 ml | 3.5 g | 24° C. | 2 | 1.93 | 0.001 |
| | | | | 3 | 1.26 | 0.001 |
| | | | | 4 | 1.94 | 0.001 |
| | | | | 5 | 4.98 | 0.003 |
| Furfural | 6 ml | 3.5 g | 22° C. | 2 | 8.31 | 0.011 |
| | | | | 3 | 7.99 | 0.011 |
| | | | | 4 | 16.42 | 0.022 |
| | | | | 5 | 48.56 | 0.064 |
| Tetramethylene Sulfoxide | 6 ml | 3.5 g | 23° C. | 2 | 9.89 | 0.011 |
| | | | | 3 | 9.86 | 0.011 |
| | | | | 4 | 28.97 | 0.031 |
| | | | | 5 | 102.25 | 0.109 |

2. The method of claim 1 wherein the hydrocarbon feedstock boils above about 260° C.

3. The method of claim 1 wherein the hydrocarbon feedstock boils above about 320° C.

4. The method of claim 1 wherein the feedstock and the TMSO are contacted in counter-current fashion in a counter-current extraction vessel.

5. The method of claim 1 wherein from 0.5 to 10 volumes of TMSO are used per volume of hydrocarbon feedstock.

6. The method of claim 1 wherein the contacting is conducted at a temperature of from 20° to 150° C.

7. The method of claim 4 wherein there is a gradient of from 0° C. to 40° C. difference in temperature between the top of the extraction vessel and the bottom of said vessel.

8. The method of claim 1 wherein the TMSO contains from 0 to 20 wt % $H_2O$.

* * * * *